United States Patent [19]

Ivey et al.

[11] Patent Number: 4,862,334

[45] Date of Patent: Aug. 29, 1989

[54] LAMP, REFLECTOR AND GRILLE INTERLOCK ASSEMBLY

[75] Inventors: Charles W. Ivey, Hope Mills; David G. Wilson; Clarence R. Thorne, both of Fayetteville, all of N.C.

[73] Assignee: Fasco Industries, Inc., Lake Forest, Ill.

[21] Appl. No.: 308,086

[22] Filed: Feb. 9, 1989

[51] Int. Cl.[4] ..... F21S 1/02

[52] U.S. Cl. ..... 362/149; 362/310; 362/374

[58] Field of Search ..... 362/148, 149, 306, 307, 362/310, 374, 375, 368

[56] References Cited

U.S. PATENT DOCUMENTS

| | | | |
|---|---|---|---|
| 2,899,542 | 8/1959 | Mauro | 362/374 X |
| 3,883,732 | 5/1975 | Peterson et al. | 362/149 X |
| 4,460,947 | 7/1984 | Kelly | 362/374 X |

*Primary Examiner*—Stephen F. Husar

*Attorney, Agent, or Firm*—Shlesinger, Fitzsimmons & Shlesinger

[57] ABSTRACT

The assembly includes a grille, a lamp housing (reflector) containing a lamp socket, and a lens. These parts are releasably attachable to each other by a pair of flexible tabs which project upwardly from the lens at opposite sides thereof, and by a pair of rigid tabs which project upwardly from opposite sides of an external flange which surrounds the lower end of the reflector. The lamp housing extends upwardly through a central opening in the grille, and the flange on its lower end engages the underside of an internal flange formed on the grille around its central opening. The rigid tabs on the lamp housing overlie the flange on the grille to secure the housing to the grille, and the flexible tabs on the lens extend through registering notches in the housing and grille flanges, and have hook-shaped upper ends which overlie the grille flange releasably to secure the lens beneath the reflector.

14 Claims, 4 Drawing Sheets

LAMP, REFLECTOR AND GRILLE INTERLOCK ASSEMBLY

BACKGROUND OF THE INVENTION

This invention relates to a lamp and grille assembly, and more particularly to an improved lamp, reflector and grille assembly which is particularly suitable for use in connection with a combined bathroom ventilator/-lamp unit, or the like. Even more particularly, this invention relates to improved means for interlocking the several parts of such an assembly.

It has long been customary to incorporate combined ventilator and lamp units in household bathrooms and the like in order to provide necessary illumination, and also to exhaust steam and odors through the ventilator sections of the units. Typically the ventilator section of the unit is mounted above the associated lamp assembly, which more often than not can be operated or energized either simultaneously with, or independently of, the associated ventilator section. Typical such units are disclosed in U.S. Pat. No. 4,681,024, and U.S. Pat. No. 3,320,406, which happen to be assigned to the same assignee as the instant application.

Among the disadvantages of prior such units has been the difficulty in reducing the expense of manufacturing and assembling the various sections of each unit. In each such case, of course, the lamp section of the unit must be designed so that it permits ready access to the associated bulb or other light source, and permits air to flow through the lamp section to the ventilator section to be exhausted thereby from a room.

It is an object of this invention, therefore, to provide for a combined ventilator/light or lamp unit of the type described an improved lamp assembly, which can be rapidly and easily attached to an associated ventilator unit.

A more specific object of this invention is to provide an improved lamp assembly of the type described which is relatively inexpensive to manufacture and simple to assemble.

Still another object of this invention is to provide a novel lamp assembly of the type described which incorporates an improved interlock mechanism that enables simple and rapid interconnection of the various parts of the lamp assembly.

Other objects of the invention will be apparent hereinafter from the specification and from the recital of the appended claims, particularly when read in conjunction with the accompanying drawings.

SUMMARY OF THE INVENTION

The assembly comprises three separate parts—a grille, a reflector containing a lamp socket, and a lens. The parts are rectangular in configuration in the embodiment illustrated, and are releasably attachable to each other by simple interlock means comprising a pair of flexible tabs located on and projecting upwardly from the lens at opposite sides thereof, and a pair of rigid tabs projecting upwardly from opposite sides of a flange which surrounds the lower end of the reflector.

The central portion of the reflector extends upwardly through a central opening in the grille, and has the flange on the lower end thereof engaged with the underside of a flange formed on the grille around its central opening. The two tabs which project up from the reflector flange overlie the flange on the grille to secure the reflector to the grille. The flexible tabs on the lens extend through registering openings or notches formed in opposite sides of reflector and grille flanges, and have on their upper ends laterally projecting dogs or teeth which overlie the grille flange releasably to secure the lens beneath the reflector.

THE DRAWINGS

DETAILED DESCRIPTION OF THE PREFERRED EMBODIMENTS

Figure 1:
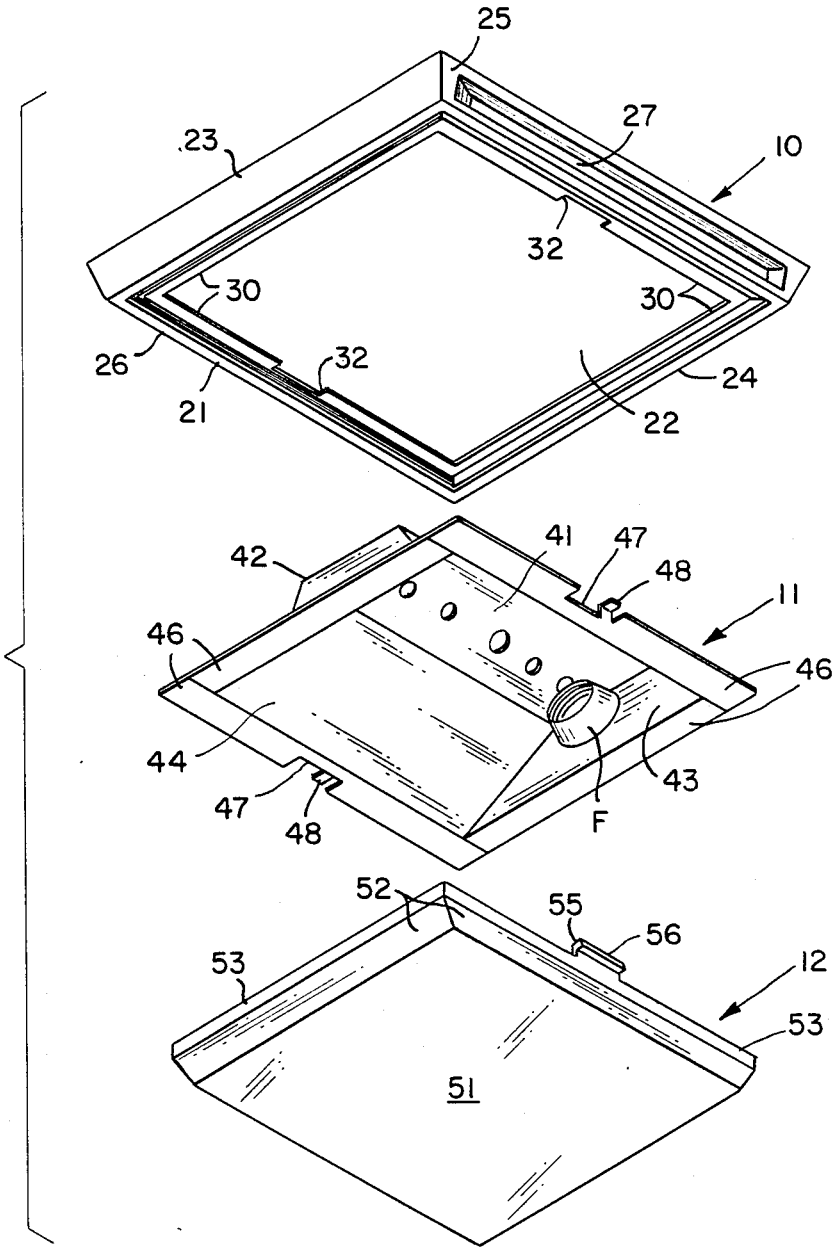
FIG. 1 is an exploded perspective view of the three separate sections—namely, the grille, the reflector, and the lens of an improved lamp assembly made according to one embodiment of this invention.
Figure 2:
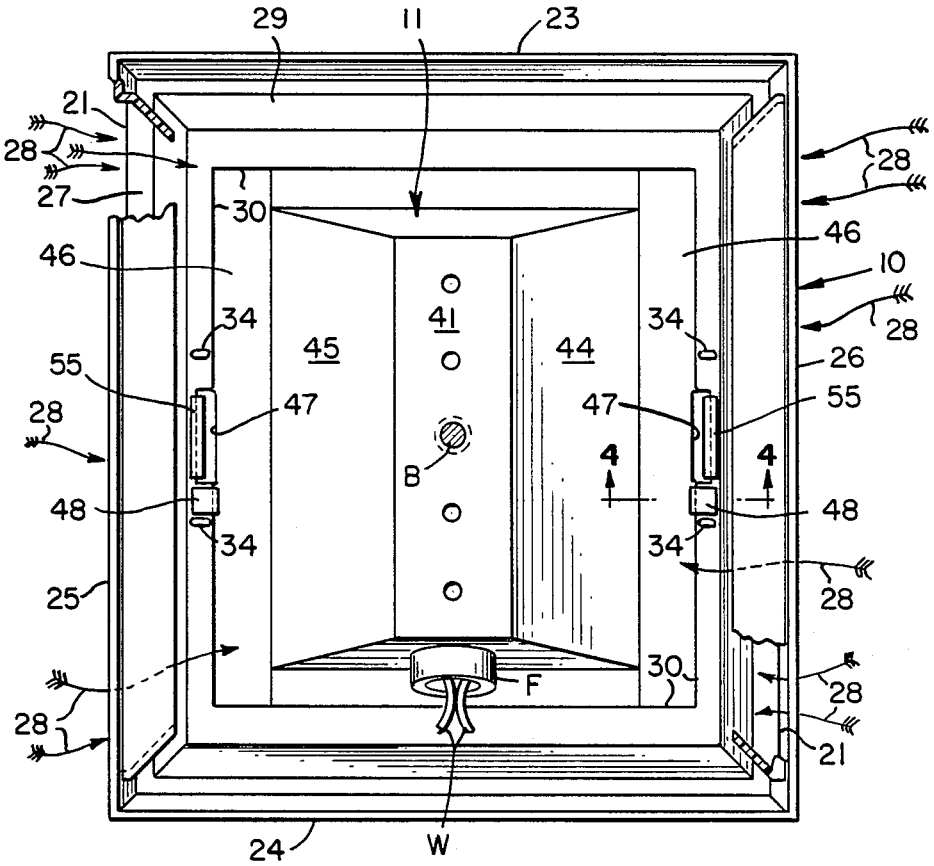
FIG. 2 is a top plan view of this lamp assembly as it appears when the three basic parts thereof have been releasably attached to each other, portions of the assembly being broken away and shown in section for purposes of illustration.
Figure 3:
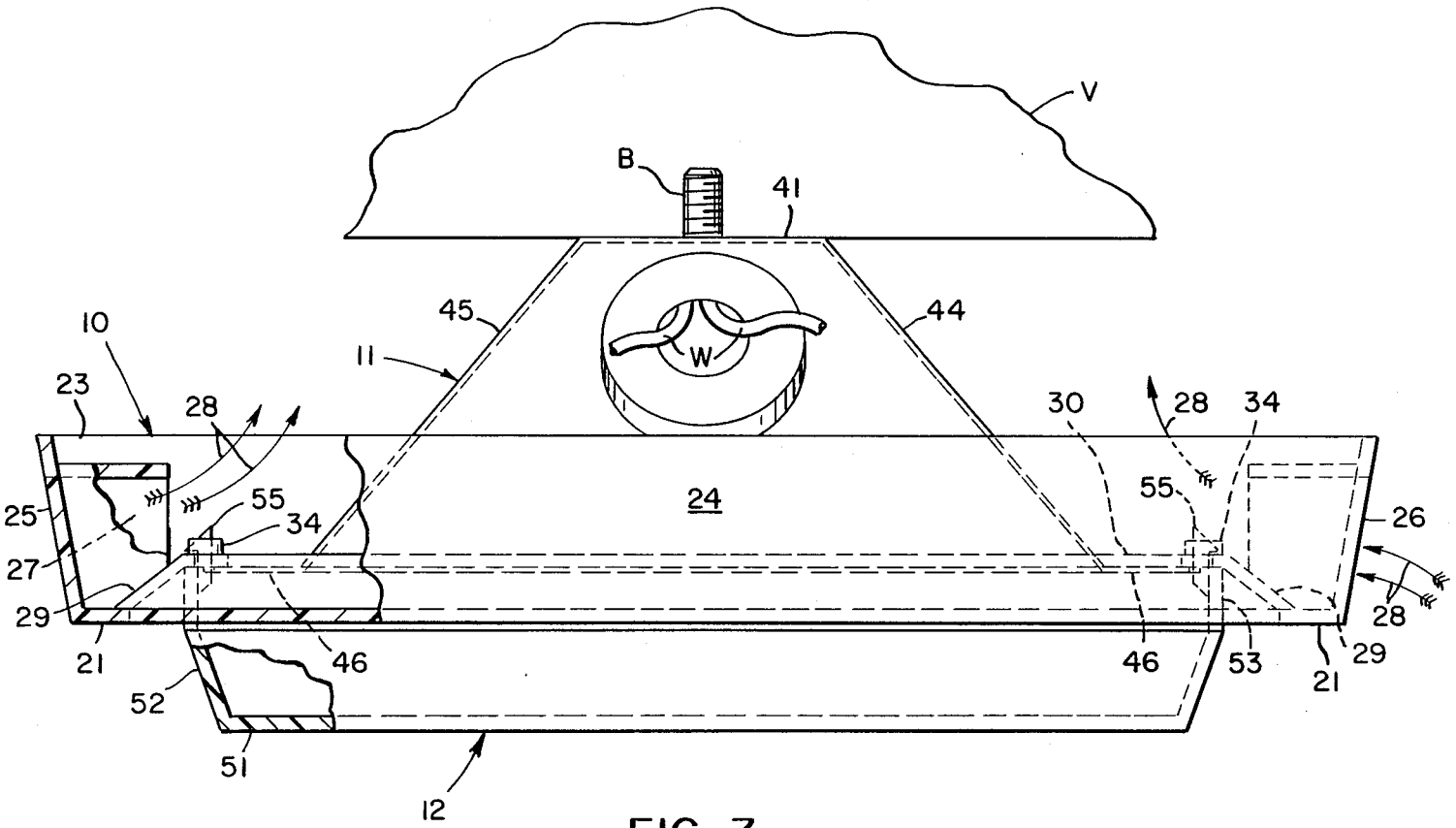
FIG. 3 is an end elevational view of the assembly shown in FIG. 2, portions of the assembly again being broken away and shown in section for purposes of illustration.

Referring now to the drawings by numerals of reference and first to FIG. 1, the three sections which make up this lamp assembly are denoted generally by the numerals 10, 11 and 12, and are respectively, the grille, the reflector and the one-piece lens. In the embodiment illustrated, these three sections are generally rectangular in configuration, and are adapted to be releasably secured to one another in the manner as shown for example in FIGS. 2 to 5.

Grille 10 comprises a plane, flat bottom wall 21, which is rectangular in configuration, and which has through the center thereof a large, rectangular opening 22. Integral with and projecting diagonally upwardly from wall 21 are the front and rear walls 23 and 24, respectively of the grille 10, and opposed side walls 25 and 26, respectively. Each of the side walls 25 and 26 has therethrough an elongate slot or air inlet opening 27, through which air is adapted to be drawn in the direction indicated by arrows 28, when the unit is placed in use as noted hereinafter.

Integral with and projecting diagonally upwardly and inwardly from the inner edge of the bottom wall 21 is an integral, truncated pyramidal section 29, which has at its upper end an integral laterally projecting flange 30, which projects part way into and surrounds the central opening 22 in grille 10. The spaced, confronting sides of the flange 30 which register with the air inlet openings 27 have formed therein spaced, confronting, generally U-shaped notches, which are located centrally of the opposed side walls 25 and 26 of the grille. For purposes noted hereinafter, each of the notched portions of the flange 30 has formed on the upper surface thereof a pair of spaced, upwardly projecting lugs or stops 34, which are equally spaced outwardly from opposite ends, respectively, of the associated notch 32 for purposes noted hereinafter.

The sheet metal reflector 11 comprises a plane, flat upper wall 41, a pair of spaced, parallel downwardly depending end walls 42 and 43, which are generally trapezoidal in configuration, and a pair of downwardly-inclined side walls 44 and 45, which are secured at opposite ends thereof to the inclined side edges of the end walls 42 and 43 of the reflector. The end wall 43 has secured therein a conventional light fixture F having the usual wires W for connecting the fixture to a power supply. The bottom of reflector 11 is surrounded by an integral, outwardly projecting lateral flange 46, which is similar in configuration to, but which is dimensionally slightly larger than, the rectangular grille opening 22 which is bound by flange 30, so that flange 46 of the reflector 11 can be made to engage the underside of the grille flange 30 when the parts are assembled as noted hereinafter. Each of the opposed side sections of the flange 46, those sections which register with the inlet openings 27 in grille 10, has therein a centrally disposed notch or recess 47 which is positioned to register vertically in the assembly with the notches 32 in the sides of the grille flange 30. Adjacent one end of each of its notches 47 the reflector flange 46 has struck up therefrom a right-angularly shaped tab 48, the upper end of which is positioned to overlie the upper surface of the flange 30 on the grille 10, when the parts are assembled.

The lens 12 comprises a plane, flat bottom wall 51, which is rectangular in configuration, and which is surrounded at its outer edges by an integral, diagonally upwardly extending flange section 52. Integral with and projecting vertically upwardly from the upper edge of the flange section 52, and at right angles to the plane bottom wall 51 of the lens 12, is a rectangularly shaped flange 53, the upper edge of which is disposed to engage against the underside of the flange 30 on the reflector 11, when the parts are assembled as shown in the drawings. Integral with or otherwise secured at their lower ends to the inside surface of the lens flange 53 substantially medially of its opposed side sections, and projecting upwardly beyond the upper edge of flange 53 are two, flexible, snap-in latching tabs 55, each of which has formed on its upper end a latching tooth or dog 56 which projects laterally outwardly and in spaced, overlapping relation to the upper edge of the flange 53.

In the embodiment illustrated, the notches 32 in the grille flange are located centrally or medially of the two sides of the grille containing the inlet openings 27. On the other hand, the mounting tabs 48, which are struck up from the reflector flange 46, are slightly offset to one side of the midpoint of the opposed side sections of flange 46; and each of them has a width approximately equal to the space between a lug 34 on flange 30 and the adjacent end of the associated slot or notch 32 in the flange. Moreover, the latching tabs 55 on the lens 12 are approximately equal in length to the length of each of the grille notches 32, and the reflector notches 47, excluding from the latter the space occupied by the tabs 48. Consequently, when the parts are assembled the latching tabs 55 on the lens 12 will register vertically with the notches 47 and 32 in the reflector and grille, respectively, at each side of the assembly.

In order to assemble the unit, the upper end of the reflector 11 is inserted upwardly through the central opening 22 in the grille 10, so that marginal edges of the flange 46 on the reflector will engage the underside of the flange 30 on the grille. The overall outer dimension of the flange 46 on the reflector 11 is such that the reflector can be slid slightly in one direction relative to the grille 10, for example upwardly in FIG. 2, until the tabs 48 on the reflector register with the notches 32 in the grille flange 10, thus permitting the tabs 48 to be inserted upwardly through the notches 32. Thereafter the reflector 11 can then be shifted in the opposite direction, for example downwardly in FIG. 2, in order to cause tabs 48 to be shifted slidably over the upper surfaces of the opposed side sections of flange 30, and into engagement with one of the set of the lugs 34, as shown for example in FIG. 2. In these positions the tabs 48 operatively connect the reflector 11 to the grille 10, so that the former can be suspended from the latter.

Figure 4:
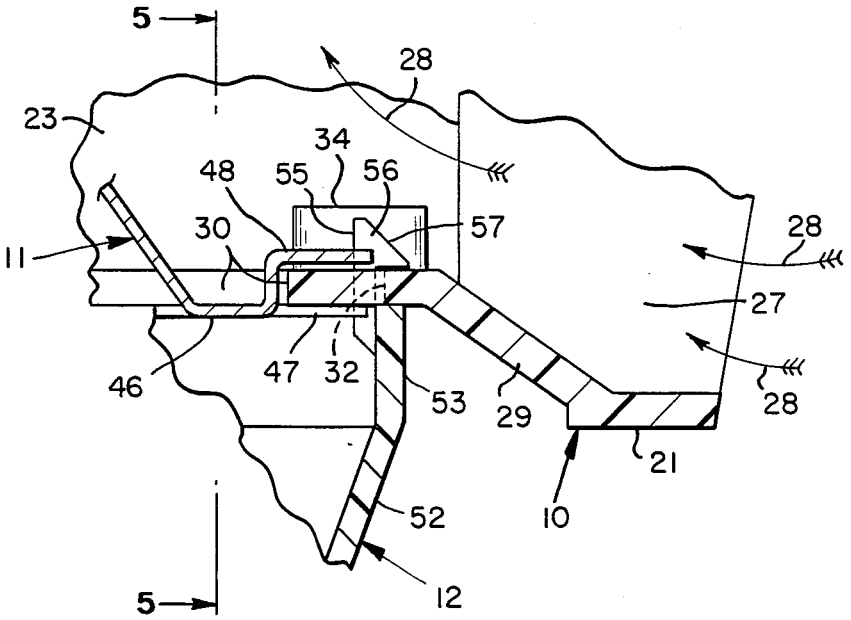
FIG. 4 is a greatly enlarged fragmentary sectional view taken generally along the lines 4—4 in FIG. 2 looking in the direction of the arrows.

After this has been done, the lens 12 is inserted upwardly so that its flexible tabs 55 pass upwardly through the registering reflector notches 47 and grille notches 32. During this motion the inclined camming surfaces 57 on the upper ends of the latching dogs 56 (one of which surfaces is illustrated in FIG. 4) cause the flexible latching tabs 55 to be flexed or tilted at their upper ends slightly inwardly toward the center of the assembly until such time that the dogs 56 on the upper ends of the tabs pass above the upper surface of the grille flange 30, at which time the tabs 55 snap at their upper ends outwardly until the dogs 56 latch over the upper surface of the grille flange 30, thus completing the assembly.

Figure 5:
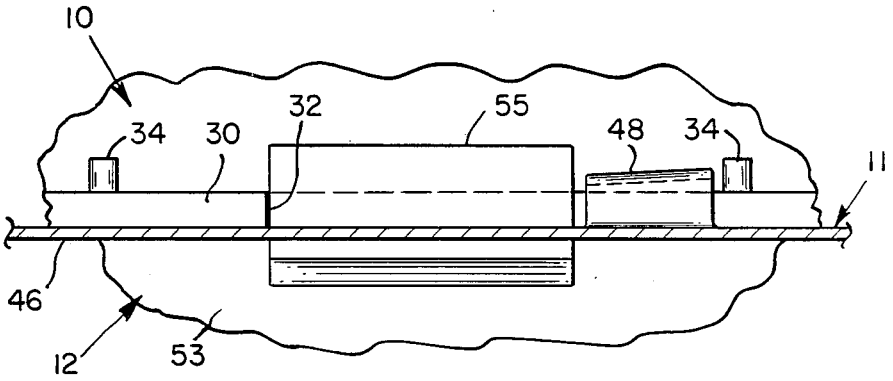
FIG. 5 is a fragmentary sectional view taken generally along the lines 5—5 in FIG. 4 looking in the direction of the arrows.

When the parts are assembled, as shown in the drawings, and particularly as illustrated in FIG. 5, each of the lens latching tabs 55 is engaged at one end with one end of the associated flange notch 32, and is positioned in confronting relation to one end of the associated tab 48 on the reflector 11, so that the tabs 48 cannot slide laterally into registry with the notch 32 in the grille 10, thus preventing separation of the parts after the assembly has been completed. On the other hand, if it is desired to disassemble the parts, one need only to push the upper ends of the latching tab 55 inwardly toward the center of the assembly until the tooth or dog shaped portions 56 thereof become disengaged from the upper surface of the grille flange 30, at which time the lens 12 can then be dropped downwardly out of the assembly. Then the reflector 11 can be slid relative to the grille 10 in a direction to permit its tabs 48 to register with the notches 32 in the grille, thus also permitting the reflector 11 is be disengaged from the grille 10.

From the foregoing it will be readily apparent that the present invention provides an extremely simple and inexpensive means for quickly assembling and disassembling, if desired, the three major components which produce the novel lamp, grille and reflector assembly made according to this invention. As noted above, lens 12 is made from a plastic material so that the tabs 55 are flexible enough to permit them to be snapped into locking engagement with the grille flange 30, when the parts are assembled; and conversely, the tabs 55 can be disengaged from flange 30 if it becomes necessary to separate the parts. The reflector 11, on the other hand, is surrounded by flange 46 which can be sandwiched between the lens 12 and grille 10, so that it is not visible from the underside of the assembly. The reflector 11 can be stamped from sheet metal in a very inexpensive manner; and since it utilizes only the two tabs 48 for securing the reflector to the grille 10, it does not require the use of any special instruments to complete assembly. Moreover, in order to attach the unit to an associated heater or ventilator mechanism, one need only utilize a headed bolt B (FIGS. 2 and 3), the shank of which can be inserted through a central opening in the upper wall 41 of the reflector 11, and can be used for securing the entire assembly to the underside of a ventilator housing or the like. To secure access to the head of the bolt B, or to the lamp socket or fixture F, one need only to flex the tabs 55 at opposite sides of the lens 12 inwardly, and then to draw the lens downwardly away from the reflector 11 to expose the interior thereof.

While this invention has been illustrated and described in detail herein in connection with only certain embodiments thereof, it will be apparent that it is capable of still further modification, and that this application is intended to cover any such modifications as may fall within the scope of one skilled in the art or the appended claims.

The claims:

1. The combination, comprising a grille having therein a central opening and a plurality spaced slots each of which communicates at one end with said central opening and at its opposite end with the exterior of the grille, a reflector having a closed end extending through said central opening in said grille beyond one side thereof, and having a flange portion projecting laterally from said central portion and engaging said grille adjacent the opposite side thereof, first latching means on said flange portion of said reflector releasably engaged with said grille to secure said reflector to said grille, means for mounting a lamp in said reflector to have light therefrom reflected by said closed end of said reflector out of an opening in the opposite end thereof, a light-transmissive lens positioned over and closing said opening in said opposite end of said reflector, and second latching means on said lens releasably engaged with said grille to secure said lens to said grille and against said flange portion on said reflector.

2. The combination as defined in claim 1, wherein each of said latching means is manually operable without the assistance of a tool selectively to engage or disengage, respectively, said grille.

3. The combination as defined in claim 1, wherein each of said latching means comprises a plurality of generally hook-shaped tabs formed on said reflector and said lens, respectively, and each of said tabs having a hook-shaped portion thereof releasably engagable with a latching surface on said grille.

4. The combination as defined in claim 3, wherein certain of said tabs are rigid, and others of said tabs are flexible.

5. The combination as defined in claim 4, wherein the flexible tabs are formed on said lens, and the rigid tabs are formed on said reflector.

6. The combination as defined in claim 1, wherein a plurality of spaced notches are formed in said grille around said central opening therein, a plurality of notches are formed in said reflector around said open end thereof to register with said notches in said grille, said first latching means comprises a plurality of rigid tabs on said reflector having hook-shaped portions thereon engaging a first plurality of latching surfaces on said grille, and said second latching means comprises a plurality of flexible tabs on said lens projecting through registering notches in said reflector and grille, respectively, and having hook-shaped portions thereon engaging a second plurality of latching surfaces on said grille.

7. The combination as defined in claim 6, wherein said first plurality of latching surfaces on said grille register with the notches in said grille, and said second plurality of latching surfaces on said grille are located adjacent to but laterally offset from the notches in said grille.

8. The combination as defined in claim 7, including means connecting said flexible tabs to said lens so that said lens may be disengaged from said grille by flexing portions of said lens adjacent said flexible tabs manually to disengage the hook-shaped portions thereof from said first plurality of latching surfaces and withdrawing the last-named tabs out of the registering notches in said reflector and grille.

9. The combination as defined in claim 8, wherein each of said rigid tabs is formed on said reflector adjacent one end of each of said notches in said reflector, and said rigid tabs are insertable through said notches in said grille and are movable laterally with said reflector relative to said grille between latching positions in which the hook-shaped portions thereof engage said second plurality of latching surfaces on said grille, and released positions in which said hook-shaped portions thereof register with said notches in said grille to be withdrawable therefrom.

10. A combination as defined in claim 1, wherein said closed end of said reflector is spaced from said one end of each of said slots in said grille.

11. A combination lamp, reflector and grille assembly for bathroom ventilators and the like, comprising a lamp housing having a closed end and an open end, and a lateral flange surrounding at least a portion of its open end, a grille surrounding the open end of said housing and having thereon an internal lateral flange engaged with one side of said lateral flange on said lamp housing, a light-transmissive lens positioned over and closing to open end of said lamp housing, and having a flange thereon engaged with the opposite side of said lateral flange on said lamp housing, means for releasably supporting a lamp in said housing to have light therefrom reflected out of the open end of said housing by the inside of the closed end of said housing, means for releasably securing the closed end of said housing to a ventilator unit operable to draw air through a plurality of slots formed in said grille around the outside of the closed end of said housing, a first plurality of tabs on said housing releasably engaged with said flange on said grille to secure said housing and grille together, and a second plurality of tabs on said lens releasably engaged with said flange on said grille adjacent said first plurality of tabs releasably to secure said lens to said grille and said housing.

12. The combination as defined in claim 11, wherein the tabs on said lens are flexible and extend through registering notches in the flanges on said housing and said grille, respectively, and have thereon hook-shaped portions which overlie and latchingly engage the flange on said grille at the side thereof remote from the side engaged by the flange on said lamp housing.

13. The combination as defined in claim 12, wherein the tabs on said housing have hook-shaped portions thereon engaged over said flange on said grille adjacent to, and at the same side thereof as, said hook-shaped portions of the tabs on said lens.

14. The combination as defined in claim 13, wherein the tabs on said lens register with said registering notches in said housing and grille flanges, and the tabs on said housing are laterally offset from the notches in said grille when the housing is secured to the grille.

* * * * *